United States Patent [19]

Benéteau

[11] Patent Number: 4,505,056

[45] Date of Patent: Mar. 19, 1985

[54] CROSS-COUNTRY SKI BOOTS

[75] Inventor: Charles Benéteau, Pouzauges, France

[73] Assignee: Patrick S.A., Pousauges, France

[21] Appl. No.: 462,890

[22] Filed: Feb. 1, 1983

[30] Foreign Application Priority Data

Feb. 5, 1982 [FR] France ..... 82 01911

[51] Int. Cl.[3] ..... A43B 5/04

[52] U.S. Cl. ..... 36/117; 36/119

[58] Field of Search ..... 36/117–121; 280/615

[56] References Cited

U.S. PATENT DOCUMENTS

| | | | |
|---|---|---|---|
| 3,228,122 | 1/1966 | Ludwig | 36/117 |
| 3,552,044 | 1/1971 | Wiele | 36/119 |
| 3,718,994 | 3/1973 | Spier | 36/117 |
| 4,261,114 | 4/1981 | Villetto | 36/120 |

FOREIGN PATENT DOCUMENTS

| | | | |
|---|---|---|---|
| 354306 | 1/1980 | Austria | 36/117 |
| 1111063 | 7/1961 | Fed. Rep. of Germany | 36/117 |
| 2459014 | 1/1981 | France | 36/117 |
| 461529 | 2/1937 | United Kingdom | 36/117 |

*Primary Examiner*—James Kee Chi

*Attorney, Agent, or Firm*—Arthur B. Colvin

[57] ABSTRACT

The present invention relates to a cross-country ski boot, wherein said boot comprises a shell in rigid plastic material, removably fittable over an inner shoe in supple material which is relatively thick for comfort and size-compensation, the upper part of said shell being entirely cut out in the area where the boot is required to bend at the same time as the metatarsus, substantially through to the outer sole and the inner shoe, which is in closed-pore wear-resistant foam, more densified in some parts than in others, comprising a thicker and compressible part which encloses the top of the foot, and which presents, in facing relation to the metatarsal perforations, of the shell, transverse grooves which also help antero-posterior bending.

7 Claims, 7 Drawing Figures

Figure 1:
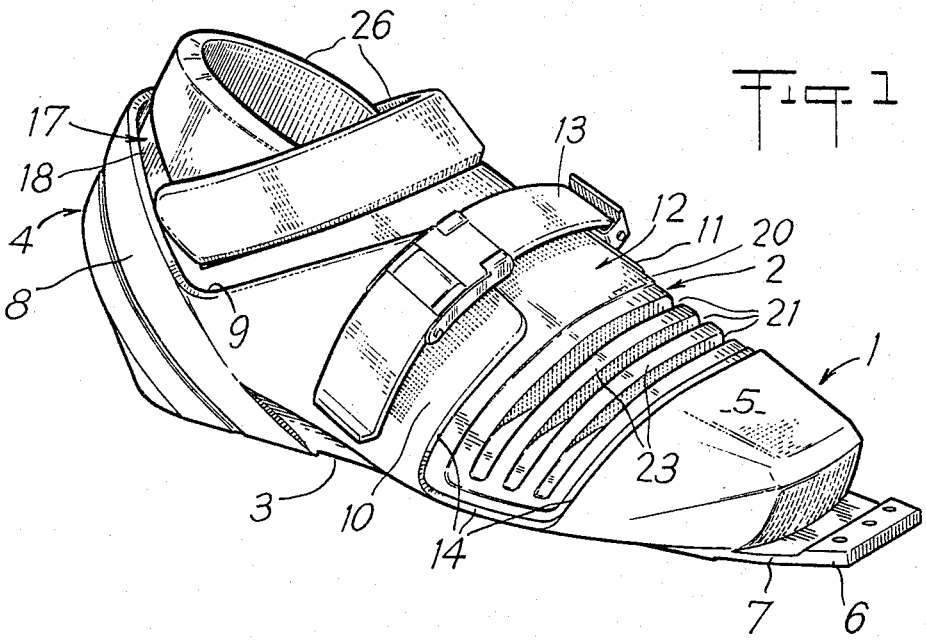

1
2
3
4
5
6
7
8
9
11
12
14
15
16
17
18
19
20
21
22
23
24
25
26
V
VI
VII

CROSS-COUNTRY SKI BOOTS

The present invention relates to a cross-country ski boot which is particularly novel due to its improvements.

Cross-country skiing or Nordic skiing, whether used as a means to travel from one place to another or as a sporting activity, only enables to move at fairly slow speed on flat or hilly snow-covered surfaces.

For this particular activity, the boot is simply secured to the ski by the front end of its sole, and the skier needs to be able to walk, and accelerate or slow up his step, but it is virtually impossible for him to make sharp turns.

According to the more recent techniques, the cross-country ski boot comprises a relatively rigid sole on which is mounted a conventional upper, usually tightened on the foot by lacing. The rigidity of the soles is obtained by different means so that it can pivot at the end of the foot with respect to the ski, bend in the area of the metatarsus to allow the foot to stretch, and this without deforming torsionally; it is indeed important that the actions of the foot on the sole can be transmitted to the ski by the sole without any twisting deformation risking to interfere with movements and to cause loss of accuracy and purity in the skier's movement.

All the improvements which have been proposed up to now, both where the articulation of the fore end of the sole on the ski, and the rigidity of said sole, are concerned, to make it bendable in the metatarsus area as well as resistant to bending, are not altogether satisfactory for the skier. They would be, if the foot had not to move in relation to the sole, except for those movements which are necessary to slide-walk with the skis. On the other hand, the upper which is mounted on said sole, tolerates, especially by the way it is joined to said sole, movements of the feet relatively thereto.

It is the object of the present invention to overcome this disadvantage by improving the cross-country ski boot so that it blocks the foot in a vertical plane traversing the longitudinal axis of the ski, whilst permitting to bend the foot at the level of the metatarsus; in this way, the ankle becomes neutralized for all lateral movements and the foot becomes integral with the bottom of the leg inside the aforesaid vertical plane, whilst participating, by showing a firm resistance to twisting, to the antero-posterior metatarsal pivoting movements.

The boot according to the invention thus fulfills the following requirements:

to pivot by its end with respect to the ski, to be bendable in its structure at the level of the metatarsus;

to show improved rigidification of the sole, to transfer said rigidification to the foot, to protect the foot against the elements and against abrasion.

To this end, the invention proposes a cross-country ski boot which comprises a shell in rigid plastic material, removably fittable over an inner shoe in supple material which is relatively thick for comfort and size-compensation; the upper part of said shell being entirely cut out in the area where the boot is required to bend at the same time as the metatarsus, substantially through to the outer sole and the inner shoe, which is in closed-pore wear-resistant foam, more densified in some parts than in others, comprising a thicker and compressible part which encloses the top of the foot and which presents, in facing relation to the metatarsal perforations of the shell, transverse grooves which also help antero-posterior bending.

Such a boot is found to give high efficient performances.

Another extremly important advantage should also be noted. The removable inner shoe housed in rigid shell is not only provided to ensure a close comfort to the wearer, it is really designed, on the one hand, as a walking shoe and on the other hand, as a size-compensating element.

This last aspect of the design enables to reduce the molding equipment to a strict minimum. Indeed, for 12 sizes of cross-country ski boots, it suffices to produce, for the shell, 4 molds maximum and for the shoe, 4 molds and 12 lasts maximum.

To be more specific, taking size 40 as an example:

one mold suffices to produce a common shell suitable for sizes 38, 39 and 40;

another mold will give the outer structure of the inner shoe adapted to that shell, and selectively cooperate with three lasts of sizes 38, 39 and 40, permitting to obtain the inner structure of the three inner shoes of these sizes.

Obviously, the molding equipment is considerably reduced, thereby reducing the manufacturing costs. But there is another advantage of a commercial nature. Indeed, it becomes possible to sell the shell and the inner shoe independently, to reduce stocks of shells and facilitate orders, and finally to simplify the hiring of these articles, since each shell can receive 3 or 4 different sizes of inner shoe.

Figure 2:
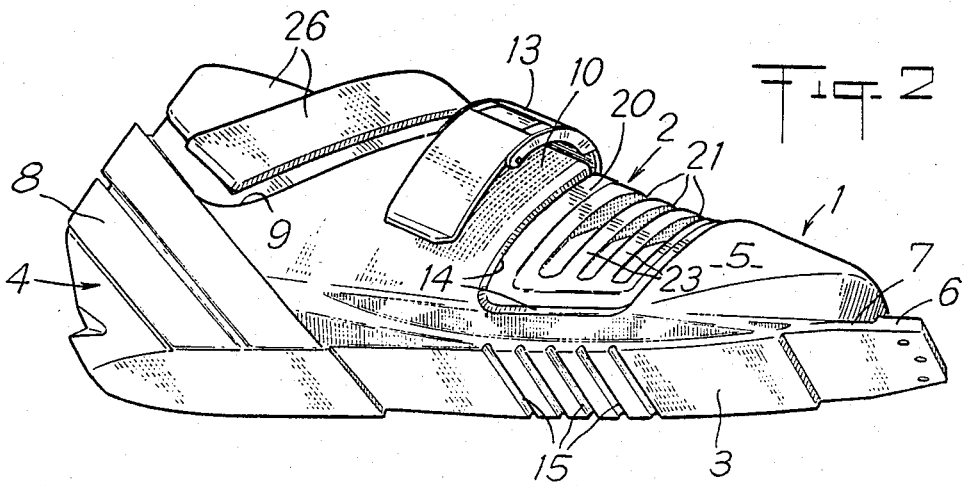
Figure 3:
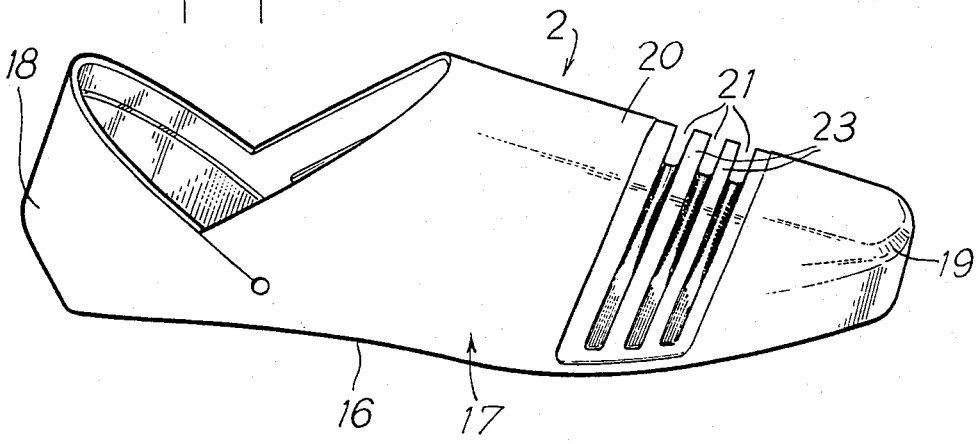
Figure 5:
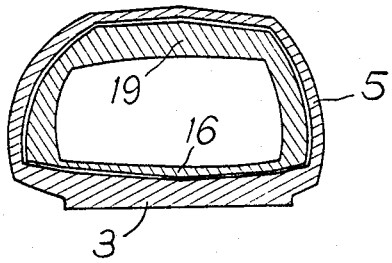
Figure 6:
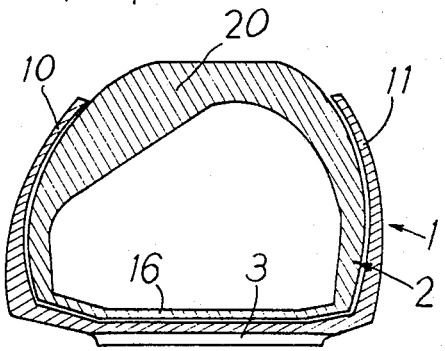
Figure 7:
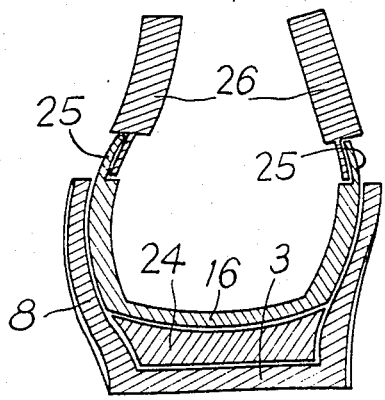
Figure 4:
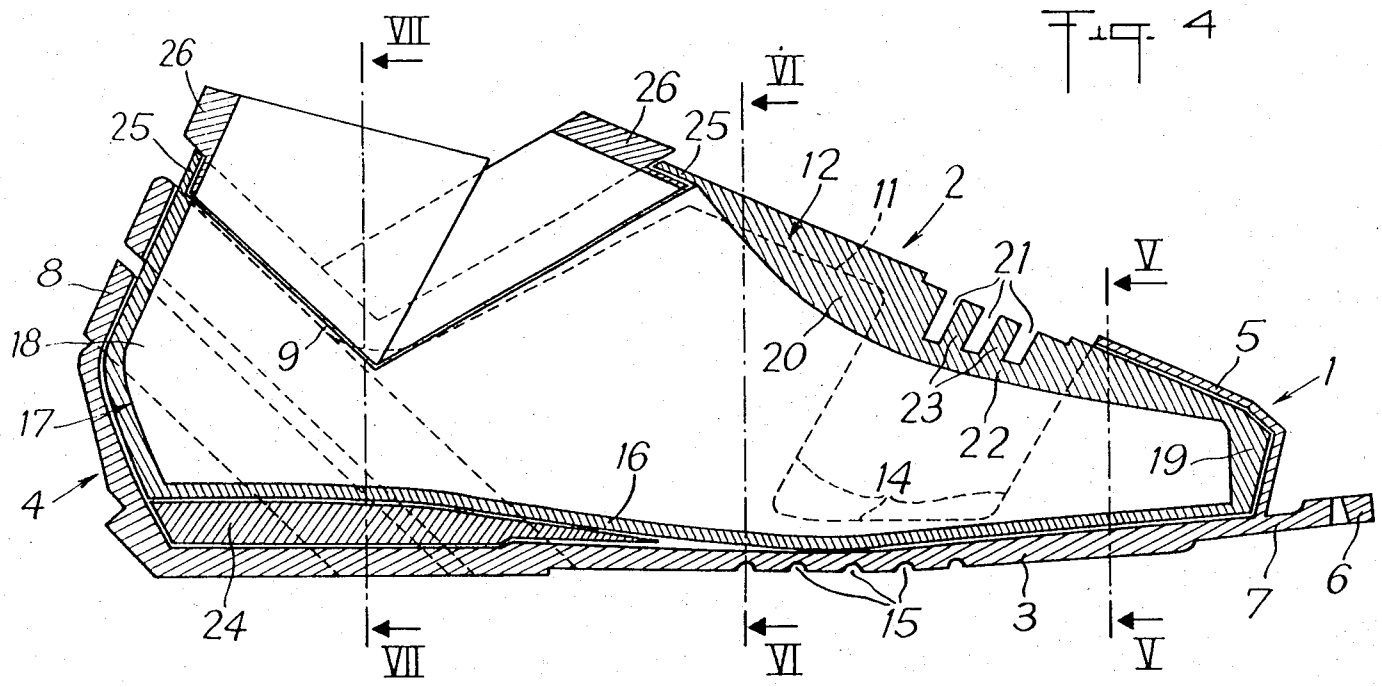

The invention will be more readily understood on reading the following description with reference to the accompanying drawings, in which:

FIG. 1 is a perspective plan view of a cross-country ski boot according to the invention, FIG. 2 is a perspective view of the same boot seen from beneath, FIG. 3 is a perspective view of the inner shoe of the boot according to the invention, before this is fitted inside the shell, FIG. 4 is a longitudinal section of said boot, FIGS. 5 to 7 are cross-sections along lines V—V, VI—VI, and VII—VII respectively of FIG. 4.

Referring now to the figures, the cross-country ski boot according to the invention comprises a shell 1 into which is inserted an inner shoe 2.

The shell 1 is produced by injecting a thermoplastic material having the required rigidity and resistance to bending at low temperature. Said shell is preferably constituted of polyester elastomers such as Du Pont de Nemours "Hytrel" or AKZO "Arnitel" and prepared in quality 55 shore D; it can also be in a thermoplastic polyurethane such as that of Bayer for example, or a polyamide such as Du Pont de Nemours "Zytel" or a polyester-polyamide copolymer, such as Ato-Chimie "Pebax".

The inner shoe is produced from supple foaming products belonging to the polyurethanes family, preferably on a polyether base, which can better withstand hydrolysis; but a polyester base is also acceptable. The foam should be a closed-pore foam for the inner shoe to be waterproof and to withstand bad weather: humidity, outwash, snow, ice. Said foam should also be wear-resistant so that the inner shoe can be used independently of the shell, for example to drive a vehicle, to walk over ground in order to reach the skiing pistes, etc.; said foam should also be relatively supple and be deformable and compressible especially when bending the foot as indicated hereinabove; it should finally be densifiable to certain extents by the conventional techniques so that certain parts (such as the sole part for example) are relatively thin and compact whereas other parts (where are for example the metatarsus and instep) are relatively thick and compressible.

Considering that the shell 1 is molded in one piece, it comprises, in momolithic manner, an outer sole 3 and an upper 4. Said upper is provided at its front end with a toe-piece the thickness of which is relatively reduced with respect to that of the outer sole 3 which on the contrary is substantially uniform. The toe-piece 5 is integral with a plate 6 provided for flexibly or hingedly joining the boot on the ski via a thinner strip 7 extending from the sole 3.

Said upper 1 is also provided at its back end with a part 8 forming stiffener and quarters. Said rising part 8 is relatively low and presents at the level of the ankle, relieving indentations 9. Said indentations define in the instep region, lateral flaps 10 and 11 which do not actually join up and are separated by a split part 12 across which is placed a clip member 13 interjoining the two flaps.

According to the invention, the flaps 10 and 11 are also separated from the toe-piece 5 by cutouts 14 extending as far as the outer sole 3. Thus, the shell 1 is relatively rigid but on the other hand it is easily bendable in the area of those cutouts 14, namely at the level of the metatarsus. And to further facilitate the antero-posterior bending of the shell, transverse grooves 15 can be made under the outer sole 3 at the level of the said cutouts 14.

The inner shoe 2 is also molded, but by foaming with variable densification. The inner shoe is therefore monolithic and has an outer sole 16 in one piece with an upper 17.

Said outer sole 16 is of relatively small and substantially constant thickness. The back part 18 of the upper which corresponds to the stiffener and to the quarters of the shell as far as their indentations are concerned, is slightly thicker, and also of relatively constant thickness. Said sole 16 and back part 18 of the upper are therefore relatively thin and compact. On the contrary, the toe-piece 19 of the upper of the inner shoe is relatively thick and compressible. The same also applies to part 20 of the upper which covers the top of the foot and therefore fills in the split portion 12 and the cutouts 14 of the shell. Said part 20 is thicker where the cutouts 14 are situated, namely in the metatarsus area, than where the flaps 10 and 11 and the toe-piece 5 are, namely in the instep and toes areas, respectively, areas wherein the thickness of part 20 goes gradually decreasing from the cutouts 14.

According to the invention, the part 20 of the inner shoe protects the foot against outside agents and against bruisings due to the hardness of the shell; in particular, by closing the clip member 13, the flaps 10 and 11 of the shell are squeezed over the inner shoe and the top 19 of said inner shoe is squeezed over the instep; thus the foot and the inner shoe become firmly bound together. But considering the relatively great thickness of the part 20 of the upper 17 of the inner shoe 2, transverse grooves 21 are made in the part 20 in the area of the cutouts 14; thus the metatarsal bending of the foot through the inner shoe is greatly helped due to the compressibility of the web 22 which is left in the part 20 and to the closeness together of the ribs 23 separating the grooves 21.

It is obviously desirable to incorporate in said boot a bevelled piece 24, forming shank or heel. In the illustrated embodiment, the bevelled piece 24 is adhesively bonded to the top of the outer sole 3 of the shell 1. But obviously, the same piece can be molded with the outer sole 16 of the inner shoe 2, with possibly a reinforcement of said piece.

It is also obvious that the shell 1 and the inner shoe 2 should remain interlocked when being on a foot and fitted tightly over it by way of the clip member 13, and this not only when the wearer is walking without skis, but also when he skies. To this effect, the back part 18 of the inner shoe 2 is convex and is held in position by fitting in the likewise convex back part 8, of complementary shape, of the shell 1.

Finally, as illustrated in FIGS. 1, 2 and 4, and more precisely in FIG. 7, the neck portion 25 of the inner shoe 2 rising slightly above the indentations 9 is provided with a supple lining 26 protecting the bottom of the leg; said lining 26 is sewn on the neck portion and can optionally be extended by a sort of funnel-like portion fitting over the socks.

The invention is in no way limited to the description given hereinabove and on the contrary covers any variant that can be brought thereto without departing from the scope thereof.

What is claimed is:

1. Cross-country ski boot, wherein said boot comprises a shell in rigid plastic material, removably fittable over an inner shoe in supple material which is relatively thick for comfort and size-compensation, the upper part of said shell being entirely cut out in the area where the boot is required to bend at the same time as the metatarsus, substantially through to the outer sole, and the inner shoe, which is in closedpore wear-resistant foam, more densified in some parts than in others, comprising a thicker and compressible part which encloses the top of the foot and which presents, in upwardly facing relation to the metatarsal perforations of the shell, transverse grooves which also help antero-posterior bending.

2. Boot as claimed in claim 1, wherein the outer sole of the shell is provided in the area corresponding to the metatarsal-cutout part, with transverse grooves which are also designed to help antero-posterior bending.

3. Boot as claimed in claim 1, wherein the shell is provided in the instep area with a split part which separates two lateral flaps, adapted to be squeezed over by a clip member which interjoins them over the inner shoe so as to hold the foot firmly for comfort.

4. Boot as claimed in claim 1, wherein the rising part of the upper of the shell is relatively low and presents, in the area of the ankle two lateral relieving indentations issuing on to the neck portion.

5. Boot as claimed in claim 1, wherein the inner shoe is monolithic and presents a convex stiffening part designed to fit inside a complementary supporting part of the shell.

6. Boot as claimed in claim 1, wherein a bevelled piece forming shank or heel is provided, which bevelled piece can indifferently be molded with the outer sole of the inner shoe or be built on to the shell, on the top of its own outer sole.

7. A cross-country ski boot comprising an outer shell of rigid plastic material, said shell being resistant to deformation under torsional stresses applied about the longitudinal axis of said shell, an inner shoe of closed pore foam removably disposed in said shell, said shell including a transversely extending cut-out section extending through the upper portion of said shell, said cut-out section extending downwardly and terminating in proximate relation to the sole of said shell, said cut-out section being positioned along the length of said shell at the area of said shell required to bend with a bending of the metatarsus, said inner shoe including at least one transversely extending groove in the upper portion thereof in registry with said cut-out of said shell section.

* * * * *